US007219638B2

(12) United States Patent
Mueller-Frank

(10) Patent No.: US 7,219,638 B2
(45) Date of Patent: May 22, 2007

(54) SYSTEM COMPRISING A CAM AND A CAM FOLLOWER ELEMENT AND USE OF SUCH A SYSTEM

(75) Inventor: Ulrich Mueller-Frank, Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 132 days.

(21) Appl. No.: 11/106,266

(22) Filed: Apr. 14, 2005

(65) Prior Publication Data

US 2005/0235936 A1 Oct. 27, 2005

(30) Foreign Application Priority Data

Apr. 23, 2004 (EP) ..... 04101692

(51) Int. Cl.
*F01L 1/00* (2006.01)

(52) U.S. Cl. ..... 123/90.21; 123/90.16; 123/90.44

(58) Field of Classification Search ..... 123/90.39, 123/90.41, 90.44, 90.16, 90.2, 90.21, 90.48, 123/90.5; 74/559, 567, 569
See application file for complete search history.

(56) References Cited

U.S. PATENT DOCUMENTS 1,541,069 A * 6/1925 Peters ..... 123/90.2
2,843,095 A * 7/1958 Prentice ..... 123/90.2

* cited by examiner

*Primary Examiner*—Ching Chang
(74) *Attorney, Agent, or Firm*—Gary A. Smith

(57) ABSTRACT

A system (1) comprising a cam (2) with a cam lug (3) and a cam follower element (11) which undergoes an oscillating reciprocating movement in the direction of its longitudinal axis (12) when the cam (2) rotates, in which the central plane (5) of the cam (2), which extends perpendicularly with respect to the rotational axis (4) of the cam (2), is arranged offset with respect to the longitudinal axis (12) of the cam follower element (11) by an eccentricity $E_1$, so that the cam follower element (11) rotates about its longitudinal axis (12) when the cam (2) is in engagement, with its cam outer face (6) along a contact line (10), with the cam follower element (11).

The cam (2) has at least one groove (7) in its cam outer face (6) in the circumferential direction at least in the area of the cam lug (3).

18 Claims, 2 Drawing Sheets

SYSTEM COMPRISING A CAM AND A CAM FOLLOWER ELEMENT AND USE OF SUCH A SYSTEM

FIELD OF THE INVENTION

The invention relates to a system comprising a cam with a cam lug and a cam follower element which undergoes an oscillating reciprocating movement in the direction of its longitudinal axis when the cam rotates, and more particularly to a cam and follower system wherein the cam and follower are offset from one another to cause a rotation of the follower about its longitudinal axis.

BACKGROUND OF THE INVENTION

A system of the abovementioned type is used, for example, in an internal combustion engine of a motor vehicle. A four-stroke working method comprises here not only the compression of the fuel/air mixture or of the combustion air and the expansion owing to the combustion taking place in the combustion chamber but also the charge-changing process. Within the scope of the charge-changing process, the combustion gases are pushed out via the outlet valves and the combustion chamber is charged with fresh mixture or fresh air via the inlet valves. In four-stroke engines lifting valves are used almost exclusively to control the charge-changing process, said valves undergoing an oscillating reciprocating movement during the operation of the internal combustion engine and in this way carrying out the opening process and closing process of the inlet and outlet openings.

The necessary activation mechanism including the valves is referred to as the valve drive. In this context, the object of the valve drive is to open and close the inlet and outlet openings of the combustion chamber at the correct times, with rapid clearance of the largest possible flow cross sections being aimed at in order to keep the throttling losses in the inflowing and outflowing gas flows low and to ensure that the combustion chamber is charged as fully as possible with fresh mixture and that the combustion gases are pushed out effectively, i.e. completely.

According to the prior art, a valve which can be moved along its longitudinal axis between a valve closed position and a valve open position, in order to clear or shut off an inlet opening or outlet opening of a combustion chamber of the internal combustion engine, is generally used for this purpose. In order to activate the valve, on the one hand valve spring means are provided in order to prestress the valve in the direction of the valve closed position, and on the other hand a valve activation device is used to open the valve counter to the prestressing force of the valve spring means.

The valve activation device comprises a cam shaft on which a plurality of cams is arranged and which is made to rotate by the crank shaft, for example by means of a chain drive, in such a way that the cam shaft, and with it the cams, rotate at half the rotational speed of the crank shaft.

Basically, a distinction is made in this context between a bottom cam shaft and a top cam shaft.

Bottom cam shafts are suitable for activating what are referred to as standing valves, but also with the aid of push rods and levers, for example rocker arms or valve arms for activating suspended valves. Standing valves are opened by pushing them upward, while suspended valves are opened by a downward movement. In this context, a plunger is usually used as an intermediate element, which is in engagement with the cam of the cam shaft, at least during the opening and closing processes.

In contrast, top cam shafts are used exclusively for activating suspended valves, with a valve drive with top cam shaft having a rocker arm, a valve arm or a plunger as a further valve drive component. The rocker arm rotates here about a fixed pivot point and, when deflected by the cam, displaces the valve counter to the prestressing force of the valve spring means in the direction of the valve open position. In the case of a valve arm which can rock about a pivot point which is arranged centrally, the cam acts on one end of the valve arm, with the valve being arranged at the opposite end of the arm.

When a plunger is used, this plunger is fitted on to that end of the rocker valve which is remote from the combustion chamber so that the plunger participates in the oscillating reciprocating movement of the valve when the cam is in engagement, with its cam outer face in the area of the cam lug along a contact line, with the plunger.

An advantage when using top cam shafts is that, in particular as a result of the elimination of the push rod, the moved mass of the valve drive is reduced and the valve drive is more rigid, i.e. less elastic.

Stringent requirements are made of the contour of the cam. On the one hand, the cam is intended, as already mentioned above, to ensure rapid opening and closing of the valves and thus rapid clearance of the largest possible flow cross sections. On the other hand it is necessary to take into account the fact that the valve drive is an elastic mass system which is subjected to severe accelerations and delays owing to the oscillating movement, in particular of the valve and of the plunger. In particular, the cam is to be prevented from lifting off from the plunger at high rotational speeds. A precise mathematical description of the valve drive is very complex and the computational representation of the rotation of the plunger is possible only by estimation. However, at this point a pair of essential aspects which are indispensable for understanding the present invention will be mentioned.

If the cam is in engagement with the plunger, the cam slides with its cam outer face along a contact line on the surface of the plunger. In the process, the rotational movement of the cam results in a reciprocating movement of the plunger. In order to facilitate the sliding and minimize the wear of both components, the contact zone between the cam and plunger is supplied with lubrication oil. Owing to the relative movement of the two components with respect to one another, a lubrication film which has different load-bearing properties depending on the angle of rotation as a result of hydrodynamics is formed between the cam outer face and the surface of the plunger. The structure of this film of lubrication oil is comparable to the structure of the layer of sliding oil in a sliding bearing, while in the present case the lubricity coefficient, which constitutes a measure of the load bearing capacity of the film of lubrication oil is not dependent on the difference between the relative component speeds but rather on the sum of the relative component speeds.

The wear of the cam and plunger is not only disadvantageous in terms of the service life of these components but also in particular in terms of the operational capability of the valve drive. Erosion of material on the cam outer face and/or the plunger surface has, in fact, on the one hand an influence on the valve play and on the other hand effects on the valve stroke and the control times, i.e. on the crank angle, at which the valve is opened and closed.

A further measure for counteracting the wear of the plunger and cam is therefore to arrange the cam and the plunger with respect to one another in such a way that the central plane of the cam which extends perpendicularly with respect to the rotational axis of the cam is arranged offset with respect to the longitudinal axis of the plunger by an eccentricity $E_1$. This eccentricity causes the plunger to rotate about its longitudinal axis when the cam is in engagement, with its cam outer face along a contact line, with the plunger.

The rotation of the plunger is caused by the fact that the areas of the cam outer face located to the left and right of the longitudinal axis of the plunger are of different sizes. The cam areas which are of different sizes act on the plunger—for the most part—with different torque values, for which reason the plunger is made to rotate owing to the difference between these two torque values. The torque values result from the product of the pressure point radius which is manifest as the distance between the respective cam area center from the longitudinal axis of the plunger, and the average frictional force which results from the pressures and the coefficients of friction along the contact line of the cam area in such a way that the average frictional force with the pressure point radius as a lever leads to a torque of a magnitude about the longitudinal axis of the plunger which is equal to the frictional forces which actually occur along the contact line, with their respective levers.

The local pressure along the contact line, and thus also the local lubricity coefficient, i.e. the load bearing capacity in the film of lubrication oil which is formed between the cam outer face and the plunger surface is, as already mentioned above, dependent on the sum of the individual relative component speeds which varies locally at a specific time. This is because the component speed of the plunger varies along the contact line, i.e. it rises as a circumferential speed with increasing radius owing to the rotational movement.

The different local circumferential speeds of the rotating plunger lead in turn to a sum of the relative component speeds which changes along the contact line so that the parameters which are dependent on these variables, in particular the lubricity coefficient, also change along the contact line. If the sum of the relative component speeds is zero, the lubricity coefficient is also zero. If the film of lubrication oil is then no longer supplied with oil, the lubrication film loses load bearing capacity. This is a borderline case such as occurs, for example, when the cam outer face with the critical contact radius is part of the contact line.

A decreasing lubricity coefficient basically has the disadvantage that as the load bearing capacity of the lubrication film decreases, the lubrication film at first increasingly leaves the range of fluid friction and there is a transition to mixed friction, while the proportion of solid body friction increases more and more as the lubricity coefficient decreases further.

Furthermore it is necessary to take into account the fact that the cam outer face of the cam has a radius of curvature which changes locally in the direction of rotation so that the speed with which the cam slides over the plunger surface changes with the rotational angle of the cam at least in the area of the cam lug. This effect also leads to constantly changing conditions in the lubrication film along the contact line. The parameters which are responsible for the load bearing capacity of the lubrication film therefore change firstly locally along the contact line and additionally as a function of time.

In trials, measurements have shown that the rotation of the plunger can vary between the absolute stationary state and, for example, 2000 rpm. This can be explained only by a lubricity coefficient which also changes greatly, i.e. by a load bearing capacity of the film of lubrication oil which changes greatly along the contact line. The continuously changing conditions in the lubrication film along the contact line ultimately also give rise to a fluctuating torque which changes greatly over time about the longitudinal axis of the plunger. This in turn results in a very irregular rotation of the plunger.

From the irregular rotation of the plunger it is therefore possible to draw conclusions about the friction conditions present along the contact line. The very pronounced fluctuations in the rotation of the plunger make it possible to conclude that the friction conditions also change greatly and encompass the entire area from pure fluid friction to solid body friction.

It is possible to assume that there are specific rotational speed ranges for the rotation of a plunger in which there is a relative optimum of the lubrication conditions between the cam and the cam follower element, while partially inadequate lubrication occurs above and below this rotational speed window, resulting in increased mixed friction as a result of contact between solid bodies. Since the wear also increases with an increasing proportion of solid body friction, basically the most wide ranging possible hydrodynamic formation of a lubrication film between the plunger and cam is aimed at.

A basic objective of designers when configuring a valve drive is to keep the wear between the cam and plunger as low as possible.

SUMMARY OF THE INVENTION

Against this background, the object of the present invention is to provide a system of the generic type with which the disadvantages known from the prior art are overcome and which has in particular a relatively low level of wear.

The object is achieved by means of a system comprising a cam with a cam lug and a cam follower element which undergoes an oscillating reciprocating movement in the direction of its longitudinal axis when the cam rotates, in which either the central plane of the cam, which extends perpendicularly with respect to the rotational axis of the cam, is arranged offset with respect to the longitudinal axis of the cam follower element by an eccentricity $E_1$, or, on the one hand, a contact face of the follower element is crowned and, on the other hand, the cam has a cam bevel with respect to its rotational axis, so that the cam follower element rotates about its longitudinal axis when the cam is in engagement, with its cam outer face along a contact line, with the cam follower element, and which is defined in that the cam has at least one groove in its cam outer face in the circumferential direction, at least in the area of the cam lug.

The embodiment of the cam according to the invention with at least one groove in the circumferential direction is the result of tests on wear by means of radionuclide technology RTM which have been carried out on a valve drive.

In said tests, the original intention was that the wear to a tribological system of an internal combustion engine which was due to operation of the engine would be intentionally increased for measuring reasons.

The valve drive as one of the systems of an internal combustion engine which is subject to most wear was selected as the tribological system. In order to increase the wear of this system additionally, measures for impeding and preventing the formation of the film of lubrication oil between the cam outer face and the plunger surface were considered. These considerations ultimately led to the arrangement of a groove in the cam outer face of the cam.

In this context, the specialists assumed that this groove would be a suitable means of disadvantageously influencing the film of lubrication oil between the plunger and cam or the formation of the film of lubrication oil and thus the load bearing capacity of the film of lubrication oil. This assumption was based on the idea that the groove would prevent a film of lubrication oil which was capable of bearing loads from being able to be formed at least in the area of the groove since the necessary build up in pressure for this would not be able to be achieved in the film of lubrication oil. The intention was that a reduction in the load bearing capacity of the film of lubrication oil would increase the proportion of solid body friction along the contact line between the plunger and cam, which would have been beneficial in terms of the desired increase in wear.

However, in fact a measurement of the wear on the plunger and cam showed that, contrary to the assumption of the specialists, the wear had not increased but rather significantly, i.e. perceptibly, decreased. The observed reduction in wear was significantly outside the measuring inaccuracy of the measuring equipment used which could basically be estimated.

From this it was concluded that the rotation of the plunger is subject to significantly smaller fluctuations in rotational speed if the cam is embodied according to the invention, i.e. with a groove. The rotation of the plunger which is essentially more regular in comparison with the prior art indicates that the film of lubrication oil is more stable and has a load bearing capacity which varies less significantly over time than has been observed with conventional cams. The measured lower wear is an indication that with the system according to the invention it has been possible to significantly reduce the proportion of solid body friction.

This fulfills the first object on which the invention is based, specifically to make available a system of the generic type with which the disadvantages which are known from the prior art are overcome and which has in particular less wear.

Furthermore, with the system according to the invention it is possible not only to reduce the wear but also to reduce the risk of what is referred to as pitting in the cam outer face.

So-called pitting comprises microscopic fatigue fractures which are caused, inter alia, by the force acting between the cam and plunger not being perpendicular to the cam surface but rather acting more or less obliquely on the cam outer face owing to its frictional force component. When pitting is formed, material is released and removed from the surface of the cam so that small craters are produced in the cam outer face, with the surface which is thus technically disrupted giving rise to a further increase in the friction between the plunger and cam.

The reduction in what is referred to as pitting is a further proof that as a result of the embodiment of the cam according to the invention a film of lubrication oil is formed between the cam and plunger which is significantly more stable and has a higher load bearing capacity than in the prior art because a film of lubrication oil which has a load bearing capacity leads to reduced friction between the components and thus causes the force acting between the cam and plunger to be at a steeper angle to the surface of the cam and the surface of the cam follower element, which actually avoids pitting.

Although the tests which were used as the basis of the present invention were performed here on a plunger, the results can readily be transferred, for which reason it is possible to speak generally of a rotating element which is activated, i.e. deflected, by the cam.

However, embodiments of the system in which the cam follower element is a plunger or a washer which passes on the reciprocating movement to another transmission element are advantageous.

Embodiments of the system in which $|E_1| \leqq 0.5$ NB, where NB designates the width of the cam in the direction of its longitudinal axis, have proven advantageous.

In particular, embodiments of the system in which $|E_1| \leqq 0.35$ NB, preferably $|E_1| \leqq 0.25$ NB, are advantageous.

Embodiments of the system in which the central line of the at least one groove forms a right angle $\alpha=90°$ with the longitudinal axis of the cam, i.e. extends parallel to the central plane of the cam, are advantageous.

In this embodiment, the areas of the cam outer face which are located to the left and right of the groove are each equally large over the entire angular range of the cam shaft. That is to say the distance between the at least one groove and the central plane of the cam does not change when the cam shaft rotates.

Cam areas of different sizes apply different magnitudes of torque to the plunger. The plunger rotates as a result of the difference between the different torques. If the cam areas of the cam outer face which are located to the left and right of the groove were to change as the cam shaft rotates, this would lead to a change in the conditions in the film of lubrication oil along the contact line with disadvantageous effects on the rotation of the plunger.

In particular embodiments of the system in which the central line of the at least one groove lies in the central plane of the cam are advantageous. This arrangement of the groove leads to a symmetrical formation of the cam which has an advantageous effect during the fabrication and possibly during the mounting of assembled cam shafts in which the cams are pushed onto the shaft. As a result, it is not necessary to pay attention to the direction of the cam when fitting it on during mounting operations.

However, embodiments of the system in which the central line of the at least one groove is arranged offset with respect to the central plane of the cam by an eccentricity $E_2$ are also advantageous. As a result, the effect which is caused by the eccentricity $E_1$ can be amplified or attenuated.

In this context, embodiments of the system in which $|E_2| \leqq 0.45$ NB, where NB designates the width of the cam in the direction of its longitudinal axis, are advantageous.

In particular, embodiments of the system in which $|E_2| \leqq 0.35$ NB, preferably $|E_2| \leqq 0.25$ NB or $|E_2| \leqq 0.15$ NB, are advantageous.

However, embodiments of the system in which $E_1=-E_2$, so that the central line of the at least one groove is aligned with the longitudinal axis of the element, are also advantageous. This embodiment provides advantages because as a result the groove is arranged in the area of the plunger surface in which the circumferential speed, which results from the product of the angular speed of the rotating plunger and the distance from the longitudinal axis of the plunger, becomes zero. The point of the plunger surface which lies on the longitudinal axis of the plunger does not, strictly speaking, in fact participate in the rotation.

Embodiments of the system in which the at least one groove has a width S where $S \leqq 0.5$ NB, where NB designates the width of the cam in the direction of its longitudinal axis, are advantageous.

In particular, embodiments of the system in which $S \leqq 0.35$ NB, preferably $S < 0.25$ NB, are advantageous. As a result, the cam outer face which is in engagement with the plunger surface is not reduced excessively, which would be disadvantageous in terms of reducing the wear.

In particular, embodiments of the system in which the at least one groove has a width S where $S \leqq 0.75$ mm are advantageous. This embodiment allows for the fact that the groove must have a certain minimum width in order to reliably prevent the formation of a film of lubrication oil with a load bearing capacity in the area of the at least one groove.

In certain applications, embodiments of the system in which the at least one groove is an annular groove which extends over the entire circumference of the cam outer face are advantageous. In particular in valve drives in which the cam is in engagement with the plunger not only in the area of the cam lug but also in the area of the cam which is remote from the cam lug, i.e. in the area of the base circle of the cam, this continuous annular embodiment of the at least one groove is advantageous in order to reduce the wear over the entire circumference.

In particular, embodiments of the system in which the at least one groove has a depth D where $D \geqq 0.8$ mm are advantageous. This embodiment allows, similarly to the requirement for a minimum width $S_{min}$ of the at least one groove, for the fact that the groove must also have a certain minimum depth in order to reliably prevent the formation of a film of lubrication oil with a load bearing capacity in the area of the at least one groove.

In the text which follows, two embodiments of the system with their essential dimensions are given below in the form of a table as examples of the system according to the invention. The numerical data is in millimeters.

| | NB | $E_1$ | $E_2$ | S | D | $B_1$ | $B_2$ | $R_1$ | $R_2$ |
|---|---|---|---|---|---|---|---|---|---|
| Example 1 | 14 | 1.5 | 2.5 | 2 | 0.8 | 8.5 | 3.5 | 1.25 | 6.75 |
| Example 2 | 14 | 1 | −1 | 3 | 1 | 4.5 | 6.5 | 3.75 | 4.75 |

The second of the partial objects on which the invention is based is achieved in that the system is used in a valve drive of a piston working machine.

What has already been stated with respect to the system according to the invention also applies to the use of the system according to the invention.

Uses of the system in which the system is used in a valve drive of an internal combustion engine are advantageous for the reasons already stated above.

Uses of the system in which the system is used as an injection pump activating means are also advantageous.

DESCRIPTION OF THE DRAWINGS

The invention will be described in more detail below with reference to two exemplary embodiments according to FIGS. 1 and 2, of which.

DETAILED DESCRIPTION OF THE PREFERRED EMBODIMENTS

Figure 1:
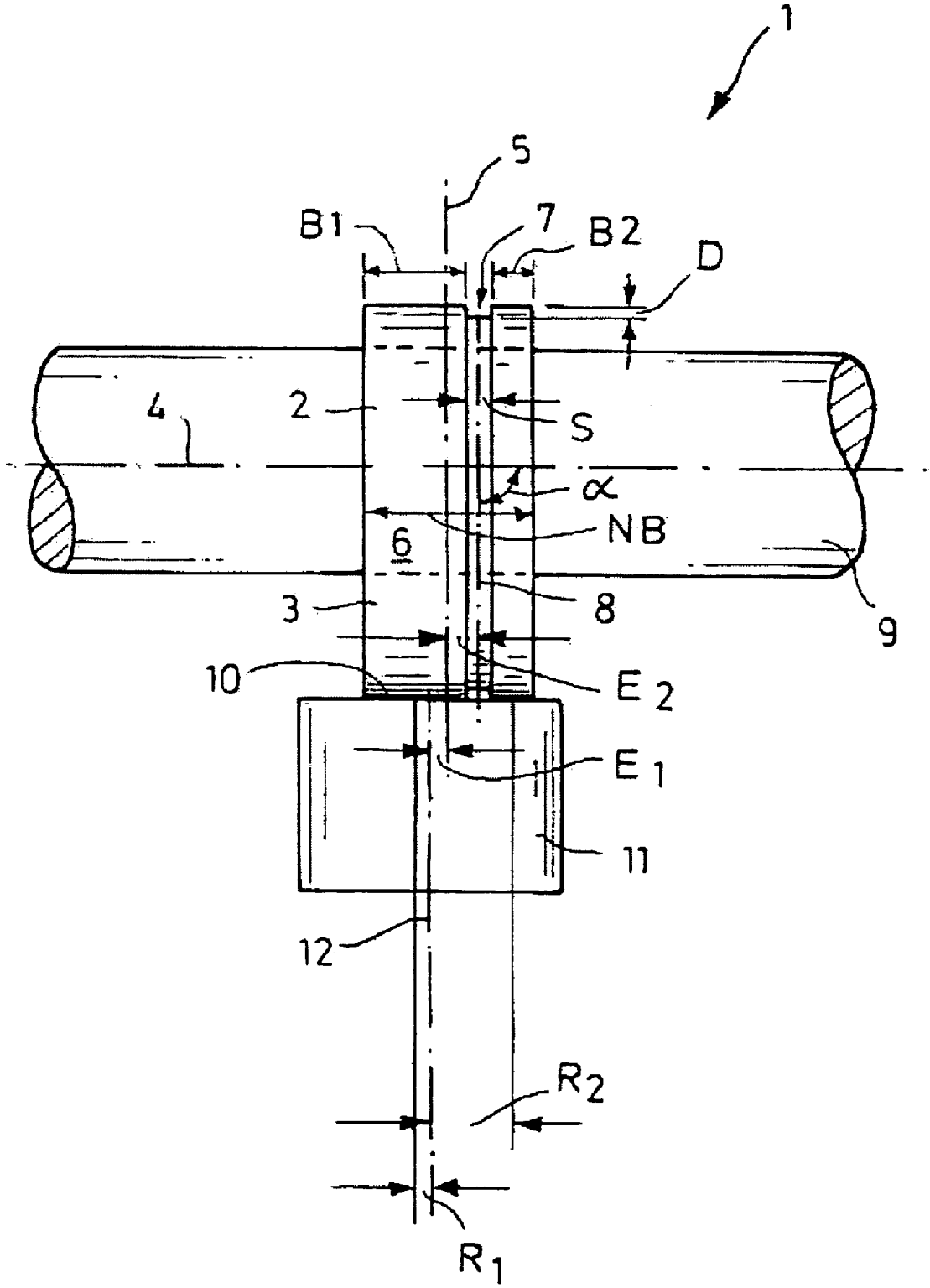
FIG. 1 is a schematic side view of a first embodiment of the system.

FIG. 1 is a schematic side view of a first embodiment of the system 1, more specifically in a viewing direction perpendicular to the rotational axis 4 of the cam shaft 9 and perpendicular to the longitudinal axis 12 of the plunger 11.

The system 1 comprises a cam 2 with a cam lug 3 and a plunger 11. The cam 2 is arranged on a cam shaft 9 and rotates with this cam shaft 9 about its longitudinal axis 4.

The cam 2 and the plunger 11 are arranged with respect to one another in such a way that the central plane 5 of the cam 2, which plane extends perpendicularly with respect to the rotational axis 4 of the cam 2, is arranged offset with respect to the longitudinal axis 12 of the plunger 11 by an eccentricity $E_1$ so that the plunger 11 rotates about its longitudinal axis 12 when the cam 2 is in engagement, with its cam outer face 6 along a contact line 10, with the plunger 11.

In the embodiment illustrated in FIG. 1, which corresponds to the example 1 specified in the table, the eccentricity $E_1$=1.5 mm.

While the system 1 is operating, the cam 2 rotates about its longitudinal axis 4 while the plunger 11 undergoes an oscillating reciprocating movement in the direction of its longitudinal axis 12 owing to the deflection by the cam 2.

A valve which is coupled to the plunger 11 is as a result moved along its longitudinal axis between a valve closed position and a valve open position and in the process clears or closes off an inlet opening or outlet opening of a combustion chamber of the internal combustion engine. When the plunger 11 is deflected by the cam 2, said plunger 11 pushes the valve in the direction of the valve open position counter to the prestressing force of the valve spring means, with the valve being closed again by the valve spring means which prestress the valve in the direction of the valve closed position.

The cam 2 is defined in that it has a groove 7 in its cam outer face 6 in the circumferential direction, with the central line 8 of the groove 7 being arranged offset with respect to the central plane 5 of the cam 2 by an eccentricity $E_2$. In this context, the central line 8 of the groove 7 forms an acute angle $\alpha$=90° with the longitudinal axis 4 of the cam 2 so that the groove extends parallel to the central plane 5 of the cam 2. In the embodiment illustrated in FIG. 1, the eccentricity $E_2$=2.5 mm, with the groove having a width S=2 mm and a depth D=0.8 mm. With a cam width NB=14 mm, S=0.14 NB therefore applies.

The groove 7 divides the cam 2 into two areas. The first cam area, lying to the left of the groove 7, has a width $B_1$=8.5 mm, with the distance between the central line of this area and the longitudinal axis 12 of the plunger 11, which corresponds to the radius $R_1$ of the left-hand pressure point, being $R_1$=1.25 mm. The second cam area lying to the right of the groove 7 has a width $B_2$=3.5 mm, with the distance between the central line of this area and the longitudinal axis 12 of the plunger 11, which corresponds to the radius $R_2$ of the right-hand pressure point, being $R_2$=6.75 mm.

The cam areas which are of different sizes apply torques of different magnitude to the plunger 11. The torques result from the product of the respective pressure point radius $R_1$, $R_2$ and the respective central frictional force $F_1$, $F_2$ which results from the pressures along the contact line 10 of the respective cam area in such a way that the central frictional force $F_1$, $F_2$ with the pressure point radius $R_1$, $R_2$ extends as a lever to form a torque about the longitudinal axis 12 of the plunger 11 which is of the same magnitude as the pressures or forces actually occurring along the contact line 10, with their respective levers.

As a result of the fact that the cam 2 is provided with a groove 7, the wear of the plunger 11 and cam 2 is significantly reduced in comparison with the prior art.

Figure 2:
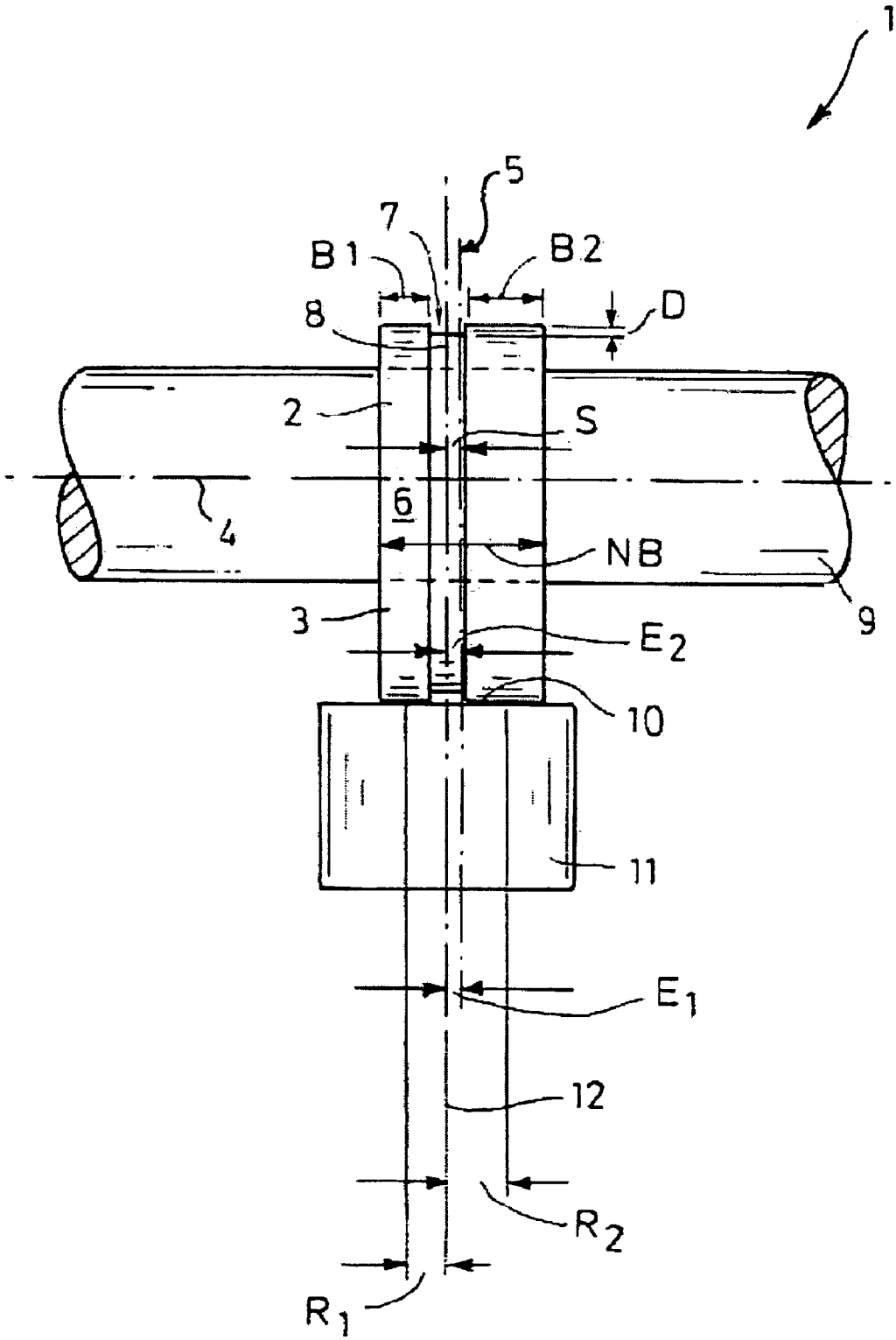
FIG. 2 is a schematic side view of a second embodiment of the system.

FIG. 2 is a schematic side view of a second embodiment of the system 1.

In contrast to the embodiment illustrated in FIG. 1, the second embodiment is defined in that $E_1=-E_2$. The eccentricity $E_1$ by which the central plane 5 of the cam 2 is arranged offset with respect to the longitudinal axis 12 of the plunger 11 corresponds in absolute terms to the eccentricity $E_2$ by which the central line 8 of the groove 7 is arranged offset with respect to the central plane 5 of the cam 2, with the eccentricity $E_1$ being positive, i.e. being directed to the left, while the eccentricity $E_1$ is negative, i.e. is directed to the right. In this way the central line 8 of the groove 7 is aligned with the longitudinal axis 12 of the plunger 11.

This embodiment provides advantages because as a result the groove 7 is arranged in the area of the plunger surface in which the circumferential speed, which results from the product of the angular speed of the rotating plunger 11 and the distance from the longitudinal axis 12 of the plunger 11, becomes zero. The point of the plunger surface which lies on the plunger longitudinal axis 12 does not participate in the rotation, for which reason it is advantageous if the cam 2 has a groove 7 at the location at which it moves over the plunger longitudinal axis 12 along the contact line 10.

Reference is also made to FIG. 1. The same reference symbols have been used for the same components. The embodiment illustrated in FIG. 2 corresponds to the example 2 specified in the table.

LIST OF REFERENCE SYMBOLS

1 System
2 Cam
3 Cam lug
4 Longitudinal axis, rotational axis of the cam
5 Central plane of the cam
6 Cam outer face
7 Groove
8 Central line of the groove
9 Cam shaft
10 Contact line between cam and element
11 Cam follower element, element, plunger
12 Longitudinal axis of the element
$\alpha$ angle between the central line of the groove and the longitudinal axis of the cam
$B_1$ width of the cam area lying to the left of the groove
$B_2$ width of the cam area lying to the right of the groove
D depth of the groove
$E_1$ eccentricity of the central plane of the cam with respect to the longitudinal axis of the element
$E_2$ eccentricity of the central plane of the groove with respect to the central plane of the cam
$F_1$ average frictional force
$F_2$ average frictional force
NB width of the cam in the direction of its longitudinal axis
$R_1$ radius of the left-hand pressure point from the longitudinal axis of the element
$R_2$ radius of the right-hand pressure point from the longitudinal axis of the element
S width of the groove
$S_{min}$ Minimum width

The invention claimed is:

1. Apparatus comprising:

a cam having a cam rotational axis, a cam central plane perpendicular to the cam rotational axis, and a cam outer face;

a follower having a contact face in contact with the cam outer face and which undergoes an oscillating reciprocating movement along a follower longitudinal axis when the cam rotates, the follower positioned relative to the cam such that the cam central plane is offset with respect to the follower longitudinal axis by an eccentricity $E_1$ measured parallel with the cam rotational axis, whereby the eccentricity $E_1$ causes the follower to rotate about the follower longitudinal axis when the cam rotates about the cam rotational axis; wherein at least one circumferential groove is formed in the cam outer face and extends at least partially around the cam, and further wherein $|E_1|\leqq 0.5$ NB, where NB designates a width of the cam measured parallel with the cam rotational axis.

2. The apparatus as claimed in claim 1, wherein the follower is a plunger.

3. The apparatus as claimed in claim 1, wherein $|E_1|\leqq 0.35$ NB.

4. The apparatus as claimed in claim 1, wherein $|E_1|\leqq 0.25$ NB.

5. The apparatus as claimed in claim 1, wherein the at least one circumferential groove has a central line forming a right angle $\alpha=90°$ with the cam rotational axis and the central line lies in the cam central plane.

6. The apparatus as claimed in claim 5, wherein the at least one groove has a width S where $S\leqq 0.5$ NB, where NB designates a longitudinal width of the cam.

7. The apparatus as claimed in claim 6, wherein $S\leqq 0.35$ NB.

8. The apparatus as claimed in claim 6, wherein $S\leqq 0.25$ NB.

9. The apparatus as claimed in claim 8, wherein the at least one groove has a width S where $S\geqq 0.75$ mm.

10. The apparatus as claimed in claim 1, wherein the at least one groove is an annular groove which extends over the entire circumference of the cam outer face.

11. The apparatus as claimed in claim 1, wherein the cam and follower are adapted for use in a valve drive of an internal combustion engine.

12. Apparatus comprising:

a cam having a cam rotational axis, a cam central plane perpendicular to the cam rotational axis, and a cam outer face;

a follower having a contact face in contact with the cam outer face and which undergoes an oscillating reciprocating movement along a follower longitudinal axis when the cam rotates, the follower positioned relative to the cam such that the cam central plane is offset with respect to the follower longitudinal axis by an eccentricity $E_1$ measured parallel with the cam rotational axis, whereby the eccentricity $E_1$ causes the follower to rotate about the follower longitudinal axis when the cam rotates about the cam rotational axis; wherein at least one circumferential groove is formed in the cam outer face and extends at least partially around the cam and has a central line forming a right angle $\alpha=90°$ with the cam rotational axis and the central line lies in the cam central plane, and further wherein the central line of the at least one circumferential groove is offset with respect to the central plane of the cam by an eccentricity $E_2$ measured parallel with the cam rotational axis.

13. The apparatus as claimed in claim 12, wherein $|E_2|\leqq 0.45$ NB, where NB a width of the cam measured parallel with the cam rotational axis.

14. The apparatus as claimed in claim 13, wherein $|E_2|\leqq 0.35$ NB.

15. The apparatus as claimed in claim 13, wherein $|E_2|\leqq 0.25$ NB.

16. The apparatus as claimed in claim 13, wherein $|E_1|<0.15$ NB.

17. The apparatus as claimed in claim 12, wherein $E_1=-E_2$, so that the central line of the at least one groove is aligned with the follower longitudinal axis.

18. Apparatus comprising:

a cam having a cam rotational axis, a cam central plane perpendicular to the cam rotational axis, and a cam outer face;

a follower having a contact face in contact with the cam outer face and which undergoes an oscillating reciprocating movement along a follower longitudinal axis when the cam rotates, the follower positioned relative to the cam such that the cam central plane is offset with respect to the follower longitudinal axis by an eccentricity $E_1$ measured parallel with the cam rotational axis, whereby the eccentricity $E_1$ causes the follower to rotate about the follower longitudinal axis when the cam rotates about the cam rotational axis; wherein at least one circumferential groove is formed in the cam outer face and extends at least partially around the cam, the at least one circumferential groove having a depth D where $D \geqq 0.8$ mm.

* * * * *